US007841828B2

(12) United States Patent
Liang

(10) Patent No.: US 7,841,828 B2
(45) Date of Patent: Nov. 30, 2010

(54) TURBINE AIRFOIL WITH SUBMERGED ENDWALL COOLING CHANNEL

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 603 days.

(21) Appl. No.: 11/543,648

(22) Filed: Oct. 5, 2006

(65) Prior Publication Data

US 2008/0085190 A1 Apr. 10, 2008

(51) Int. Cl.
*F01D 9/06* (2006.01)

(52) U.S. Cl. ..... 415/191; 416/193 A

(58) Field of Classification Search ..... 415/115, 415/191, 211.2, 914; 416/97 R, 193 A
See application file for complete search history.

(56) References Cited

U.S. PATENT DOCUMENTS

| | | | | |
|---|---|---|---|---|
| 3,446,481 | A | 5/1969 | Kydd | |
| 3,529,902 | A | 9/1970 | Emmerson | |
| 4,017,213 | A | 4/1977 | Przirembel | |
| 5,340,278 | A | 8/1994 | Mogowan | |
| 5,649,806 | A | 7/1997 | Scricca et al. | |
| 6,283,713 | B1 | 9/2001 | Harvey et al. | |
| 6,382,908 | B1 * | 5/2002 | Keith et al. | 415/115 |
| 6,419,446 | B1 | 7/2002 | Kvasnak et al. | |
| 6,478,540 | B2 | 11/2002 | Abuaf et al. | |
| 6,830,432 | B1 * | 12/2004 | Scott et al. | 416/97 R |
| 6,884,029 | B2 * | 4/2005 | Beeck | 415/191 |
| 6,945,750 | B2 | 9/2005 | Benedetti et al. | |
| 7,249,933 | B2 * | 7/2007 | Lee et al. | 416/97 R |
| 7,467,922 | B2 * | 12/2008 | Beeck et al. | 416/97 R |
| 7,597,536 | B1 * | 10/2009 | Liang | 415/138 |
| 2004/0052643 | A1 | 3/2004 | Bunker | |
| 2005/0175444 | A1 * | 8/2005 | Liang | 415/115 |
| 2006/0083613 | A1 | 4/2006 | Cunha et al. | |
| 2006/0083614 | A1 | 4/2006 | Cunha et al. | |

FOREIGN PATENT DOCUMENTS

EP 1 087 102 A2 3/2001

* cited by examiner

*Primary Examiner*—Edward Look
*Assistant Examiner*—Ryan H Ellis

(57) ABSTRACT

A turbine airfoil usable in a turbine engine and having at least one cooling system. At least a portion of the cooling system may be positioned in an endwall attached to the turbine airfoil. The endwall may include a submerged endwall cooling channel at the intersection between the generally elongated airfoil and the first endwall. The second endwall attached to the endwall on an end generally opposite to the first endwall may have a submerged endwall cooling channel as well. The submerged endwall cooling channels may include film cooling orifices to form vortices of cooling fluids to enhance cooling capacity of the cooling system of the turbine airfoil.

18 Claims, 5 Drawing Sheets

TURBINE AIRFOIL WITH SUBMERGED ENDWALL COOLING CHANNEL

FIELD OF THE INVENTION

This invention is directed generally to turbine airfoils, and more particularly to hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine vanes are formed from an elongated portion forming a vane having one end configured to be coupled to a vane carrier and an opposite end configured to be movably coupled to an inner endwall. The vane is ordinarily composed of a leading edge, a trailing edge, a suction side, and a pressure side. The inner aspects of most turbine vanes typically contain an intricate maze of cooling circuits forming a cooling system. The cooling circuits in the vanes receive air from the compressor of the turbine engine and pass the air through the ends of the vane adapted to be coupled to the vane carrier. The cooling circuits often include multiple flow paths that are designed to maintain all aspects of the turbine vane at a relatively uniform temperature. At least some of the air passing through these cooling circuits is exhausted through orifices in the leading edge, trailing edge, suction side, and pressure side of the vane.

Many conventional turbine vanes also include film cooling holes in the endwall of the vane. The film cooling holes provide discrete cooling but suffer from numerous drawbacks. For instance, high film cooling effectiveness is difficult to establish and maintain in a highly turbulent environment and large pressure differential region, such as at the intersection between the leading edge and the endwall. In addition, the large pressure gradient that exists at the intersection between the leading edge and the endwall often disrupts the film cooling established by the film cooling holes. Furthermore, the areas between the film cooling orifices and areas immediately downstream from the film cooling orifices are typically not in contact with the cooling fluids and therefore are not cooled by the cooling fluids. Consequently, these areas are more susceptible to thermal degradation and over temperatures.

As shown in FIG. 1, turbine vanes often experience horseshoe vortex flow phenomenon created by the combination of hot gas radial velocity and static pressure gradient forces at the intersection of the airfoil leading edge and the endwall. As the hot gas flow encounters the airfoil and collides with the leading edge, the horseshoe vortex separates into pressure side and suction side downward vortices. Initially, the pressure vortex sweeps downward and flows along the airfoil pressure side. However, the pressure side vortex shifts to the suction side of an adjacent airfoil due to the pressure differential between the pressure side and suction side of the adjacent airfoil. As the vortex flows to the suction side, the vortex grows in size and strength and becomes much larger than the vortex located at the suction side and creates a high heat transfer and high gas temperature region at the suction side.

Conventional backside impingement has not been successful in cooling this region. In addition, traditional film cooling has likewise been unsuccessful because effective cooling may only be partially achieved when the impingement orifices are tightly packed together. However, such formation of closely packed film cooling orifices is difficult to manufacture. Conversely, spacing the film cooling orifices further apart creates regions that do not receive film cooling air and are more susceptible to thermal degradation. Thus, such configuration is not an acceptable alternative. Thus, a need exists for a turbine vane having increased cooling efficiency for dissipating heat at the intersection of the turbine blade and the endwall.

SUMMARY OF THE INVENTION

This invention relates to a turbine airfoil cooling system configured to cool internal and external aspects of a turbine airfoil usable in a turbine engine. In at least one embodiment, the turbine airfoil cooling system may be configured to be included within a stationary turbine vane. The turbine airfoil cooling system may include one or more submerged endwall cooling channels positioned in an endwall attached to a generally elongated airfoil that forms a portion of the turbine airfoil. The submerged endwall cooling channel may be positioned proximate to an intersection between the endwall and the generally elongated airfoil such that the submerged endwall cooling channel extends around a leading edge, a pressure side, a trailing edge, and a suction side of the generally elongated airfoil. The submerged endwall cooling channel may include one or more film cooling orifices for creating vortices in the submerged endwall cooling channel and enhancing the efficiency of the cooling system. For clarity, the following description describes the submerged endwall cooling channel positioned in the inner endwall. However, one or more submerged endwall cooling channels may also be positioned in the outer endwall as well. All components of the submerged endwall cooling channel in the inner endwall may be positioned in the outer endwall.

The turbine airfoil may be formed from the generally elongated hollow airfoil having an outer surface adapted for use, for example, in an axial flow turbine engine. The outer surface may have a generally concave shaped portion forming the pressure side and a generally convex shaped portion forming the suction side. The turbine vane may also include an outer endwall at a first end adapted to be coupled to a hook attachment and may include an inner endwall at a second end. The airfoil may also include a leading edge and a trailing edge.

The submerged endwall cooling channel may extend around the generally elongated airfoil. In particular, the submerged endwall cooling channel may be positioned in the inner endwall around the leading edge, the pressure side, the trailing edge, and the suction side of the generally elongated airfoil. The submerged endwall cooling channel may be immediately adjacent to a fillet formed at the intersection between the inner endwall and the generally elongated airfoil. The submerged endwall cooling channel is constructed with an outer surface extending inward of the outer surface of the endwall. The submerged endwall cooling channel may have various configurations. In at least one embodiment, the submerged endwall cooling channel may have a generally semicircular cross-section. The submerged endwall cooling channel may transition smoothly into the outer surface of the generally elongated airfoil and into the outer surface of the endwall. A fillet may be included at the transition between the outer surface of the submerged endwall cooling channel and the outer surface of the inner endwall.

The inner endwall may also include a combined submerged exhaust channel positioned in the outer wall of the inner endwall. The combined submerged exhaust channel may extend between the submerged endwall cooling channel at the trailing edge of the generally elongated airfoil and a downstream edge of the inner endwall. The combined submerged exhaust channel may extend from the submerged endwall cooling channel on the pressure side of the generally elongated airfoil and from the submerged endwall cooling channel on the suction side of the generally elongated airfoil.

An advantage of this invention is that the submerged endwall cooling channel forms a depression in the endwall enabling cooling fluids exhausted from the film cooling orifices in the submerged endwall cooling channel to collect and form a film cooling layer in the submerged endwall cooling channel at the intersection of the leading edge and the endwall where, without the submerged endwall cooling channel, over temperatures where previously encountered in conventional designs.

Another advantage of this invention is that the submerged endwall cooling channel provides improved cooling along the submerged endwall cooling channel and improved film formation relative to the conventional discrete film cooling holes.

Yet another advantage is that film cooling holes on the endwall of the airfoil leading edge provides convective film cooling for the leading edge as well as reduces the down draft hot gas air for the intersection of the leading edge and the endwall.

Another advantage of this invention is that cooling air that collects in the submerged endwall cooling channel dilutes the hot gas air and provides film cooling to downstream components.

Still another advantage of this invention is that the submerged endwall cooling channel increases the uniformity of the film cooling and insulates the endwall from the passing hot gases by establishing a durable cooling fluid film at the submerged endwall cooling channel.

Another advantage of this invention is that the submerged endwall cooling channel minimizes cooling loss or degradation of the cooling fluid film, which provides more effective film cooling for film development and maintenance.

Yet another advantage of this invention is that the submerged endwall cooling channels create additional local volume for the expansion of the down draft hot core gases, slows the secondary flow and reduces the pressure gradient, thereby weakening the vortex and minimizing the high heat transfer coefficients created due to the vortex at the leading edge.

Another advantage of this invention is that the submerged endwall cooling channel extends the cooling air continuously along the interface of the airfoil leading edge, thereby minimizing thermally induced stress created in conventional configurations with discrete film cooling holes.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
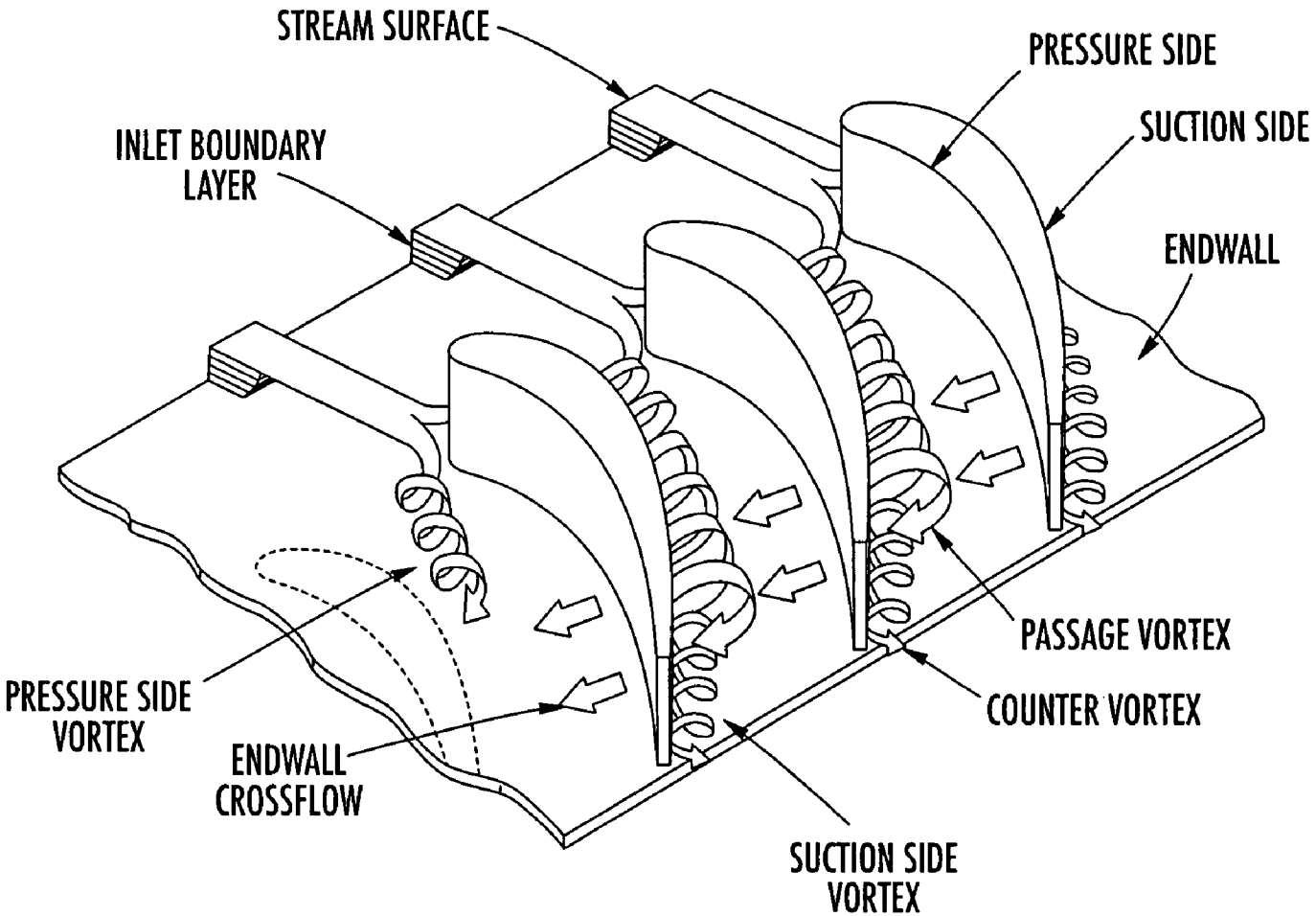
FIG. 1 (PRIOR ART)
FIG. 1 is a partial perspective view of hot gas flow around turbine airfoils of the prior art.

As shown in FIGS. 2-6, this invention is directed to a turbine airfoil cooling system 10 configured to cool internal and external aspects of a turbine airfoil 12 usable in a turbine engine. In at least one embodiment, the turbine airfoil cooling system 10 may be configured to be included within a stationary turbine vane, as shown in FIGS. 2-6. The turbine airfoil cooling system 10 may include one or more submerged endwall cooling channels 14 positioned in an endwall 16 attached to a generally elongated airfoil 18 that forms a portion of the turbine airfoil 12. The submerged endwall cooling channel 14 may be positioned proximate to an intersection 20 between the endwall 16 and the generally elongated airfoil 18 such that the submerged endwall cooling channel 14 extends around a leading edge 22, a pressure side 24, a trailing edge 26, and a suction side 28 of the generally elongated airfoil 18. The submerged endwall cooling channel 14 may include one or more film cooling orifices 30 for creating vortices in the submerged endwall cooling channel 14 and enhancing the efficiency of the cooling system 10.

Figure 2:
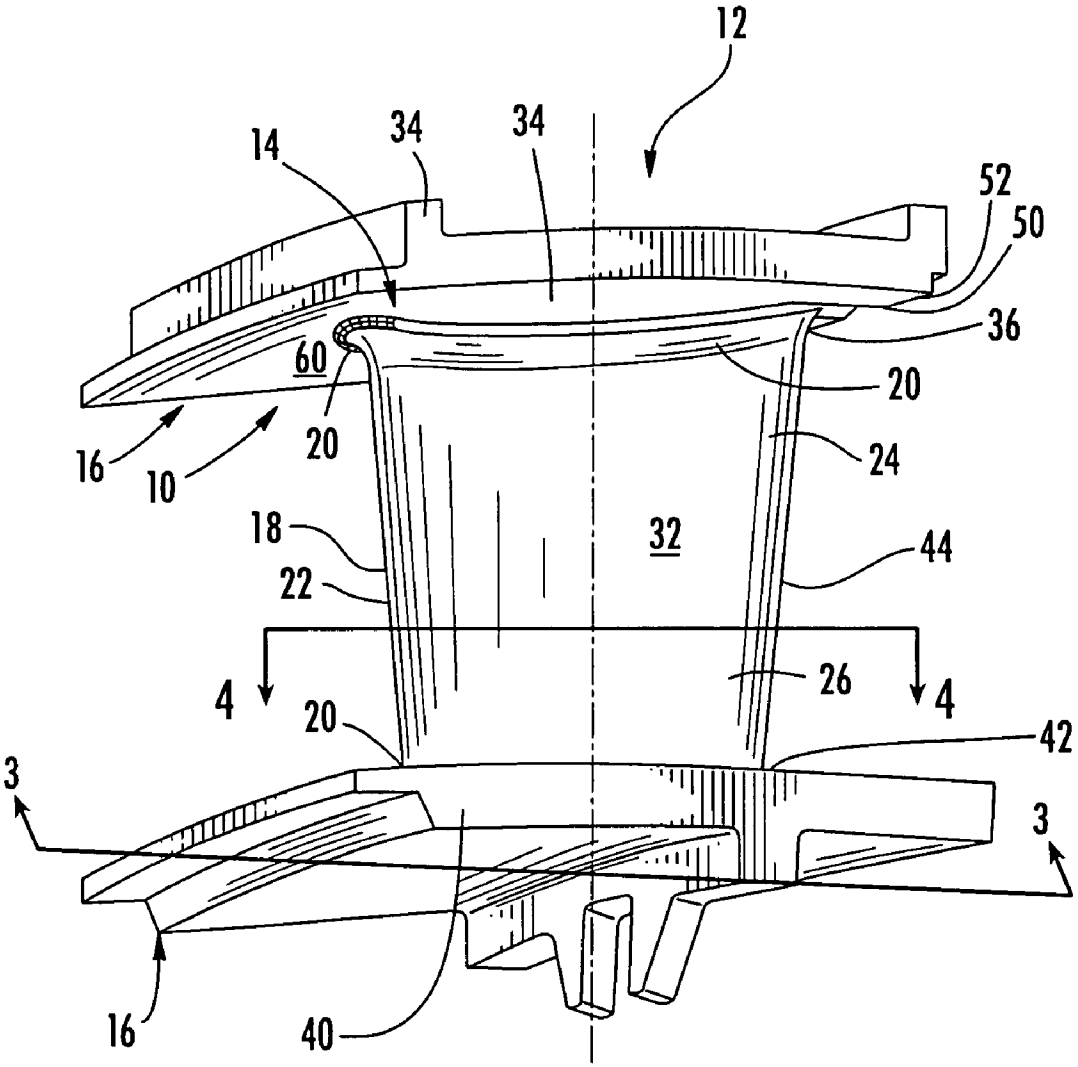
FIG. 2 is a perspective view of a turbine airfoil having features according to the instant invention.

As shown in FIG. 2, the turbine airfoil 12 may be formed from the generally elongated hollow airfoil 18 having an outer surface 32 adapted for use, for example, in an axial flow turbine engine. Outer surface 32 may have a generally concave shaped portion forming the pressure side 24 and a generally convex shaped portion forming the suction side 28. The turbine vane 12 may also include an outer endwall 34 at a first end 36 adapted to be coupled to a hook attachment and may include an inner endwall 40 at a second end 42. The airfoil 18 may also include the leading edge 22 and a trailing edge 26.

Figure 3:
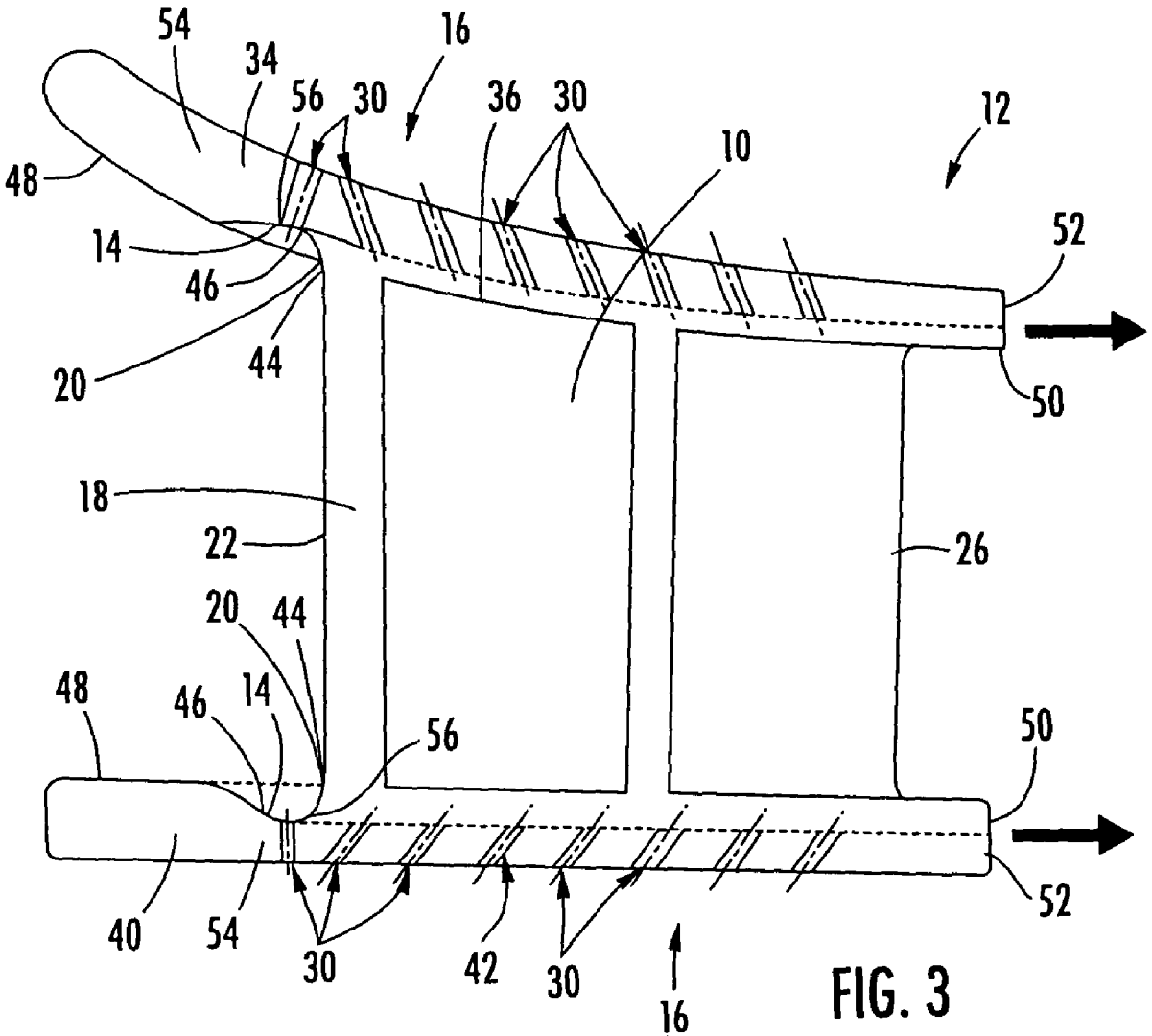
FIG. 3 is a cross-sectional view of the turbine airfoil shown in FIG. 2 taken along line 3-3.
Figure 4:
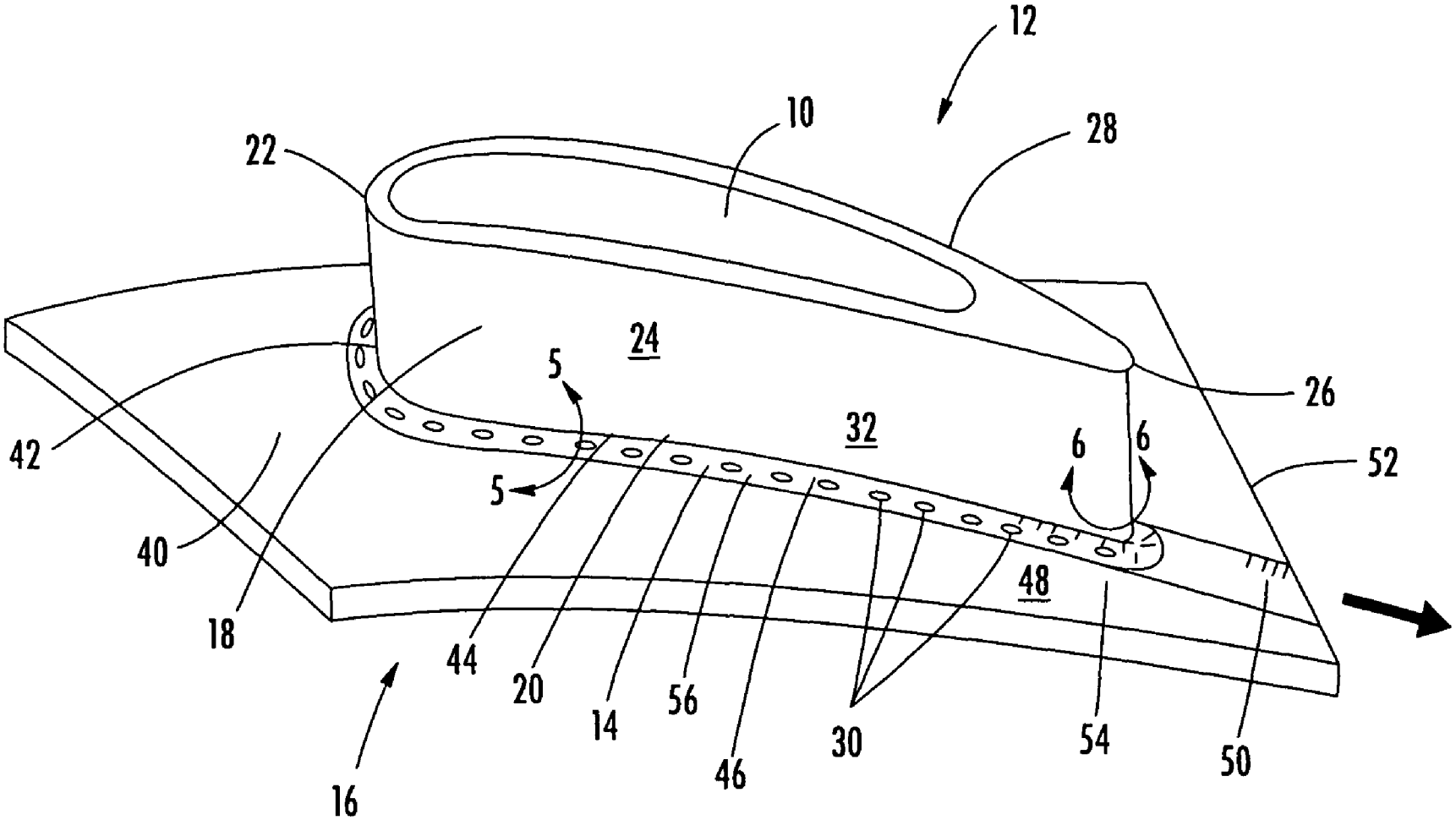
FIG. 4 is a partial cross-sectional view of the turbine airfoil shown in FIG. 2 taken along line 4-4.
Figure 6:
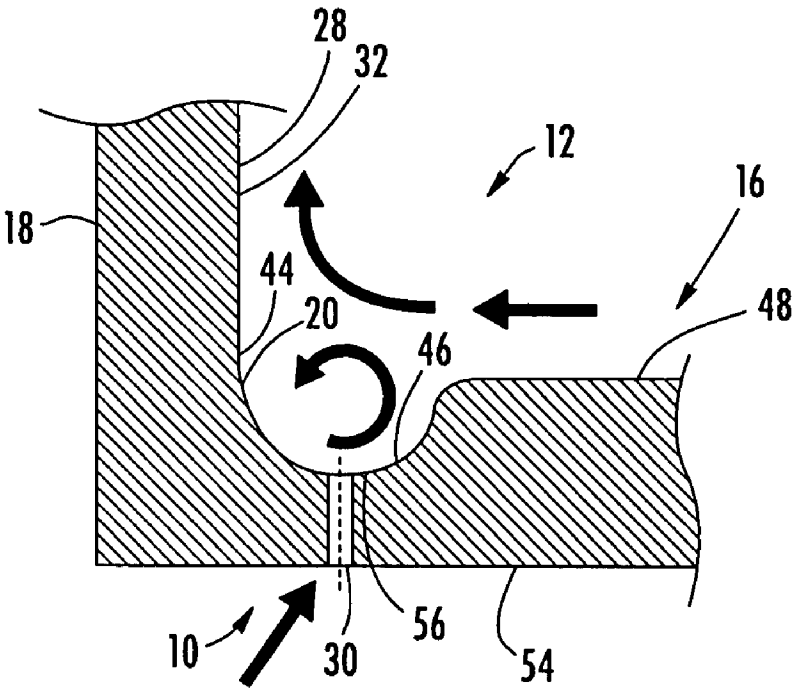
FIG. 6 is a partial cross-sectional view of an outer wall forming the suction side and the first endwall taken along line 6-6 in FIG. 4.
Figure 5:
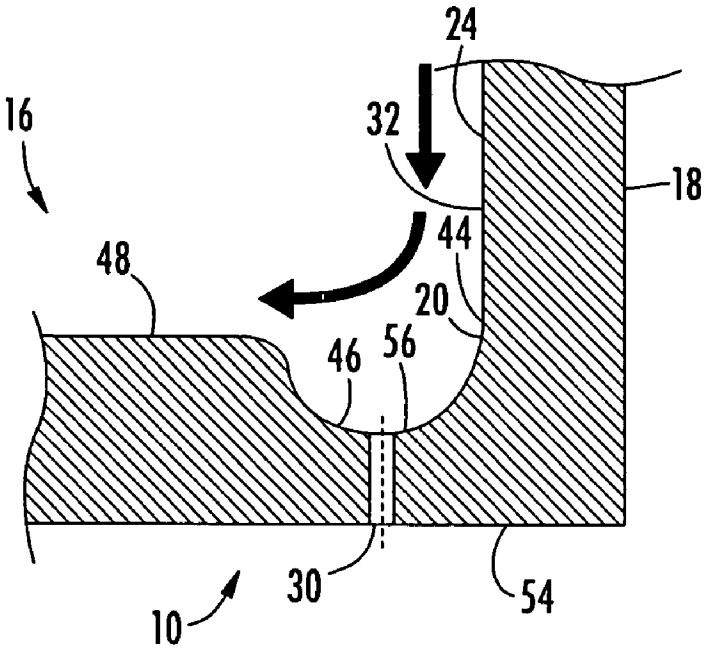
FIG. 5 is a partial cross-sectional view of an outer wall forming the pressure side and the first endwall taken along line 5-5 in FIG. 4.

As shown in FIGS. 2-4, the submerged endwall cooling channel 14 may extend around the generally elongated airfoil 18. In particular, the submerged endwall cooling channel 14 may be positioned in the inner endwall 40 around the leading edge 22, the pressure side 24, the trailing edge 26, and the suction side 28 of the generally elongated airfoil 18. The submerged endwall cooling channel 14 may be immediately adjacent to a fillet 44 formed at the intersection 20 between the inner endwall 40 and the generally elongated airfoil 18. The submerged endwall cooling channel 14 is constructed with an outer surface 46 extending inward of the outer surface 48 of the endwall 16. The submerged endwall cooling channel 14 may have various configurations. In at least one embodiment, as shown in FIGS. 3, 5 and 6, the submerged endwall cooling channel 14 may have a generally semicircular cross-section. The submerged endwall cooling channel 14 may transition smoothly into the outer surface 32 of the generally elongated airfoil 18 and into the outer surface 48 of the endwall. A fillet 50 may be included at the transition between the outer surface 46 of the submerged endwall cooling channel 14 and the outer surface 48 of the inner endwall 40.

The inner endwall 40 may also include a combined submerged exhaust channel 50 positioned in the outer wall of the inner endwall 40. The combined submerged exhaust channel 50 may extend between the submerged endwall cooling channel 14 at the trailing edge 26 of the generally elongated airfoil 18 and a downstream edge 52 of the inner endwall 40. The combined submerged exhaust channel 50 may extend from the submerged endwall cooling channel 14 on the pressure side 24 of the generally elongated airfoil 18 and from the submerged endwall cooling channel 14 on the suction side 28 of the generally elongated airfoil 18.

The turbine airfoil 12 may also include one or more film cooling orifices 30 in the outer wall 54 forming the inner endwall 40. The film cooling orifices 30 may not extend from the internal cooling system 10 to the outer surface 46 of the submerged endwall cooling channel 14. In at least one embodiment, as shown in FIG. 3, the turbine airfoil 12 may include a plurality of film cooling orifices 30. One or more, or all, of the film cooling orifices 30 may be positioned at an acute angle relative to the outer surface 48 of the inner endwall 40 such that cooling fluids may be exhausted in a downstream direction toward the downstream edge 52 of the inner endwall 40. The film cooling orifices 30 may be positioned at a bottommost portion 56 of the submerged endwall cooling channel 14 or in another position. As shown in FIGS. 3, 5 and 6, the film cooling orifices 30 may be positioned in a single line in the submerged endwall cooling channel 14.

As shown in FIGS. 2 and 3, the submerged endwall cooling channel 14 may extend around the generally elongated airfoil 18 in the outer endwall 34 similar to the configuration in the inner endwall 40. In particular, the submerged endwall cooling channel 14 may be positioned in the outer endwall 34 around the leading edge 22, the pressure side 24, the trailing edge 26, and the suction side 28 of the generally elongated airfoil 18. The submerged endwall cooling channel 14 may be immediately adjacent to a fillet 44 formed at the intersection 20 between the outer endwall 34 and the generally elongated airfoil 18. The submerged endwall cooling channel 14 is constructed with an outer surface 46 extending inward of the outer surface 48 of the endwall 16. The submerged endwall cooling channel 14 may have various configurations. In at least one embodiment, as shown in FIGS. 3, 5 and 6, the submerged endwall cooling channel 14 may have a generally semicircular cross-section. The submerged endwall cooling channel 14 may transition smoothly into the outer surface 32 of the generally elongated airfoil 18 and into the outer surface 48 of the endwall. A fillet may be included at the transition between the outer surface 46 of the submerged endwall cooling channel 14 and the outer surface 48 of the outer endwall 34.

The outer endwall 34 may also include a combined submerged exhaust channel 50 positioned in the outer wall of the outer endwall 34. The combined submerged exhaust channel 50 may extend between the submerged endwall cooling channel 14 at the trailing edge 26 of the generally elongated airfoil 18 and a downstream edge 52 of the outer endwall 34. The combined submerged exhaust channel 50 may extend from the submerged endwall cooling channel 14 on the pressure side 24 of the generally elongated airfoil 18 and from the submerged endwall cooling channel 14 on the suction side 28 of the generally elongated airfoil 18.

The turbine airfoil 12 may also include one or more film cooling orifices 30 in the outer wall 54 forming the outer endwall 34. The film cooling orifices 30 may extend from the internal cooling system 10 to the outer surface 46 of the submerged endwall cooling channel 14. In at least one embodiment, as shown in FIG. 3, the turbine airfoil 12 may include a plurality of film cooling orifices 30. One or more, or all, of the film cooling orifices 30 may be positioned at an acute angle relative to the outer surface 48 of the outer endwall 34 such that cooling fluids may be exhausted in a downstream direction toward the downstream edge 52 of the outer endwall 34. The film cooling orifices 30 may be positioned at a bottommost portion 56 of the submerged endwall cooling channel 14 or in another position. As shown in FIGS. 3, 5 and 6, the film cooling orifices 30 may be positioned in a single line in the submerged endwall cooling channel 14.

During use, the cooling fluids may be exhausted from internal aspects of the turbine airfoil cooling system 10 through the film cooling orifices 30 in the submerged endwall cooling channel 14. Because the film cooling orifices 30 are angled in a downstream direction of the hot gas flow and the submerged endwall cooling channel 14 is positioned inwardly in the endwall 16, the cooling fluids exhausted from the film cooling orifices 30 build up and slow down secondary hot gas flow proximate to the outer surface 48 of the endwall 16. As such, cooling fluids may be retained in the submerged endwall cooling channel 14. As shown in FIG. 6, the cooling fluids may form vortices in the submerged endwall cooling channel 14 that prevent combustor gases flowing past an adjacent turbine airfoil from increasing the heat load on the intersection 20 between the generally elongated airfoil 18 and the endwall 16.

Spent cooling fluids may be passed out of the submerged endwall cooling channel 14 onto the outer surface 48 of the endwall 16 to provide additional film cooling for the downstream aspects of the turbine airfoil 12. In addition, the cooling fluids may flow downstream to the high heat load wake region at the downstream edge 52 before being discharged into the vane aft rim cavity.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated hollow airfoil formed from an outer wall, and having a leading edge, a trailing edge, a pressure side, a suction side, a first endwall at a first end, a second endwall at a second end opposite the first end;

at least one submerged endwall cooling channel positioned in the first endwall proximate to an intersection between the generally elongated airfoil and the first endwall such that the at least one submerged endwall cooling channel extends around the leading edge, along the pressure side, around the trailing edge, and along the suction side of the generally elongated hollow airfoil;

wherein the at least one submerged endwall cooling channel has an outer surface positioned inward of an outer surface of the first endwall;

wherein the outer surface of the first endwall defines a portion of the at least one submerged endwall; and a plurality of film cooling orifices in the outer wall extending from an internal cooling system to the outer surface of the at least one submerged endwall cooling channel;

wherein at least one of the film cooling orifices is positioned at a bottommost portion of the at least one submerged endwall cooling channel.

2. The turbine airfoil of claim 1, wherein at least one of the film cooling orifices is positioned at an acute angle relative to the outer surface of the first endwall such that cooling fluids are exhausted in a downstream direction.

3. The turbine airfoil of claim 1, wherein the at least one submerged endwall cooling channel has a generally semicircular cross-section.

4. The turbine airfoil of claim 1, further comprising a combined submerged exhaust channel positioned in the outer wall of the first endwall and extending between the at least one submerged endwall cooling channel at the trailing edge of the generally elongated airfoil and a downstream edge of the first endwall.

5. The turbine airfoil of claim 1, further comprising at least one submerged endwall cooling channel positioned in the second endwall proximate to an intersection between the generally elongated airfoil and the second endwall such that the at least one submerged endwall cooling channel extends around the leading edge, along the pressure side, around the trailing edge, and along the suction side of the generally elongated hollow airfoil; and wherein the at least one submerged endwall cooling channel has an outer surface positioned inward of an outer surface of the second endwall.

6. The turbine airfoil of claim 5, further comprising at least one film cooling orifice in the outer wall of the second endwall extending from an internal cooling system to the outer surface of the at least one submerged endwall cooling channel.

7. The turbine airfoil of claim 6, wherein the at least one film cooling orifice in the outer wall of the second endwall comprises a plurality of film cooling orifices in the outer wall and positioned in the at least one submerged endwall cooling channel.

8. The turbine airfoil of claim 7, wherein at least one of the film cooling orifices is positioned at an acute angle relative to the outer surface of the second endwall such that cooling fluids are exhausted in a downstream direction.

9. The turbine airfoil of claim 7, wherein at least one of the film cooling orifices is positioned at a bottommost portion of the at least one submerged endwall cooling channel in the second endwall.

10. The turbine airfoil of claim 5, wherein the at least one submerged endwall cooling channel in the second endwall has a generally semicircular cross-section.

11. The turbine airfoil of claim 5, further comprising a combined submerged exhaust channel positioned in the outer wall of the second endwall and extending between the at least one submerged endwall cooling channel at the trailing edge of the generally elongated airfoil and a downstream edge of the second endwall.

12. A turbine airfoil, comprising:

a generally elongated hollow airfoil formed from an outer wall, and having a leading edge, a trailing edge, a pressure side, a suction side, a first endwall at a first end, a second endwall at a second end opposite the first end;

at least one submerged endwall cooling channel positioned in the first endwall proximate to an intersection between the generally elongated airfoil and the first endwall such that the at least one submerged endwall cooling channel extends around the leading edge, along the pressure side, around the trailing edge, and along the suction side of the generally elongated hollow airfoil;

wherein the at least one submerged endwall cooling channel in the first endwall has an outer surface positioned inward of an outer surface of the first endwall;

at least one submerged endwall cooling channel positioned in the second endwall proximate to an intersection between the generally elongated airfoil and the second endwall such that the at least one submerged endwall cooling channel extends around the leading edge, along the pressure side, around the trailing edge, and along the suction side of the generally elongated hollow airfoil;

wherein the at least one submerged endwall cooling channel in the at least one submerged endwall cooling channel has an outer surface positioned inward of an outer surface of the second endwall;

wherein the outer surface of the first endwall defines a portion of the at least one submerged endwall;

at least one film cooling orifice in the outer wall extending from an internal cooling system to the outer surface of the at least one submerged endwall cooling channel in the first endwall; and at least one film cooling orifice in the outer wall of the second endwall extending from an internal cooling system to the outer surface of the at least one submerged endwall cooling channel.

13. The turbine airfoil of claim 12, wherein the at least one film cooling orifice in the outer wall comprises a plurality of film cooling orifices in the outer wall and positioned in the at least one submerged endwall cooling channel and the at least one film cooling orifice in the outer wall of the second endwall comprises a plurality of film cooling orifices in the outer wall and positioned in the at least one submerged endwall cooling channel.

14. The turbine airfoil of claim 13, wherein at least one of the film cooling orifices in the first endwall is positioned at an acute angle relative to the outer surface of the first endwall such that cooling fluids are exhausted in a downstream direction and wherein at least one of the film cooling orifices in the second endwall is positioned at an acute angle relative to the outer surface of the second endwall such that cooling fluids are exhausted in a downstream direction.

15. The turbine airfoil of claim 12, wherein the at least one submerged endwall cooling channel in the first endwall has a generally semicircular cross-section and the at least one submerged endwall cooling channel in the second endwall has a generally semicircular cross-section.

16. The turbine airfoil of claim 12, further comprising a combined submerged exhaust channel positioned in the outer wall of the first endwall and extending between the at least one submerged endwall cooling channel at the trailing edge of the generally elongated airfoil and a downstream edge of the first endwall.

17. The turbine airfoil of claim 16, further comprising a combined submerged exhaust channel positioned in the outer wall of the second endwall and extending between the at least one submerged endwall cooling channel at the trailing edge of the generally elongated airfoil and a downstream edge of the second endwall.

18. A turbine airfoil, comprising:

a generally elongated hollow airfoil formed from an outer wall, and having a leading edge, a trailing edge, a pressure side, a suction side, a first endwall at a first end, a second endwall at a second end opposite the first end;

at least one submerged endwall cooling channel positioned in the first endwall proximate to an intersection between the generally elongated airfoil and the first endwall such that the at least one submerged endwall cooling channel extends around the leading edge, along the pressure side, around the trailing edge, and along the suction side of the generally elongated hollow airfoil;

wherein the at least one submerged endwall cooling channel has an outer surface positioned inward of an outer surface of the first endwall;

wherein the outer surface of the first endwall defines a portion of the at least one submerged endwall; and a plurality of film cooling orifices in the outer wall extending from an internal cooling system to the outer surface of the at least one submerged endwall cooling channel;

wherein at least one of the film cooling orifices is positioned at an acute angle relative to the outer surface of the first endwall such that cooling fluids are exhausted in a downstream direction.

* * * * *